US006155174A

United States Patent [19]

Hervieu et al.

[11] Patent Number: 6,155,174

[45] Date of Patent: Dec. 5, 2000

[54] COLOR MARKER MUNITION

[75] Inventors: Ghislain Hervieu, Le Mans; Jean-Pierre Le Pezennec, Bourges; Henri Thepin, Quantilly, all of France

[73] Assignee: Giat Industries, France

[21] Appl. No.: 09/112,195

[22] Filed: Jul. 9, 1998

[30] Foreign Application Priority Data

Jul. 9, 1997 [FR] France ..... 97 08704

[51] Int. Cl.[7] ..... F42B 10/00; F42B 8/00; F42B 8/12

[52] U.S. Cl. ..... 102/513; 102/529; 102/395; 102/498

[58] Field of Search ..... 102/513, 529, 102/395, 498

[56] References Cited

U.S. PATENT DOCUMENTS

| | | | |
|---|---|---|---|
| 3,429,263 | 2/1969 | Snyder et al. | 102/513 |
| 3,706,151 | 12/1972 | McNeill | 42/1 |
| 4,826,535 | 5/1989 | Godly | 106/209 |
| 5,018,450 | 5/1991 | Smith | 102/513 |
| 5,352,279 | 10/1994 | Fusi et al. | 106/19 |
| 5,353,712 | 10/1994 | Olson | 102/513 |
| 5,448,951 | 9/1995 | Olson | 102/513 |
| 5,639,526 | 6/1997 | Kotsiopoulos et al. | 473/577 |

FOREIGN PATENT DOCUMENTS

| | | |
|---|---|---|
| 0774642 | 5/1997 | European Pat. Off. . |
| 4343728 | 6/1995 | Germany . |
| 202176 | 8/1923 | United Kingdom . |
| 96/09351 | 3/1996 | WIPO . |

*Primary Examiner*—Charles T. Jordan
*Assistant Examiner*—Aileen J. Baker
*Attorney, Agent, or Firm*—Parkhurst & Wendel, L.L.P.

[57] ABSTRACT

The invention relates to the technical field of exercise munitions and more particularly to the color marker compositions for such munitions.

The marker composition according to the invention comprises at least one container (12) holding a marker composition (14) and a dispersive explosive charge (16). It is characterized in that the container (12) is substantially cylindrical, the dispersive explosive charge (16) being situated at the level of the container axis and in that the marker composition comprises at least one pigment in the form a solid, coloring powder dispersed in water, the powder being combined with a water-soluble binder and with a rheological component which is also water-soluble and which is intended to agglomerate the pigments and to increase the composition's viscosity, the composition further including an antifreeze agent.

14 Claims, 3 Drawing Sheets

COLOR MARKER MUNITION

Figure 1:
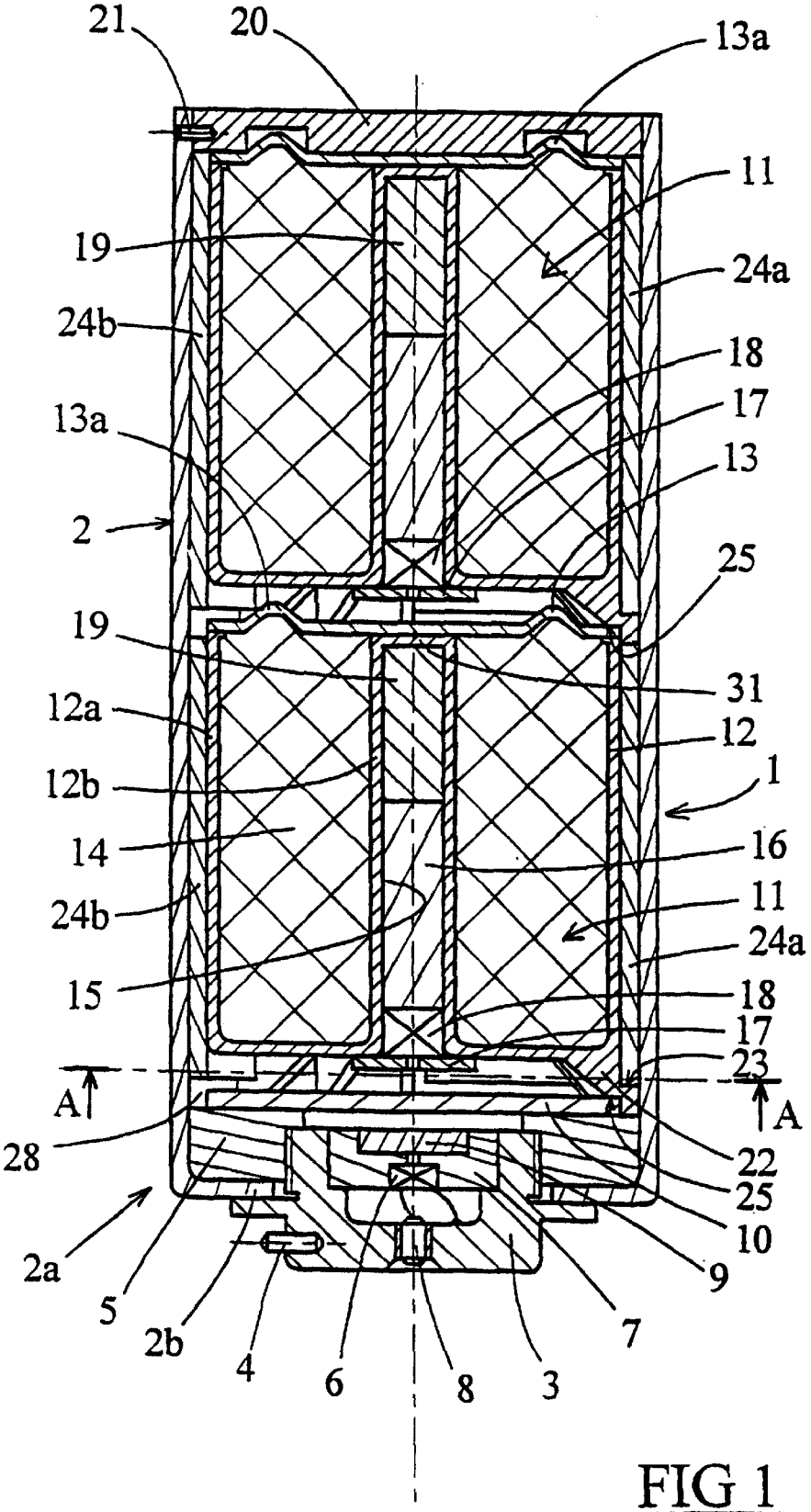

The technical field of the invention relates to munitions used in military exercises and in particular to color marker munitions.

Color marker munitions for military exercises already are known, for instance from U.S. Pat. No. 5,639,526 that comprise a projectile fitted with a thin plastic case enclosing a marker composition. This projectile fragments upon impact on a target on which it spreads the marker composition. While such a munition well simulates direct fire from small-caliber weapons, on the other hand it cannot be used to simulate the far effects for instance from a shell or grenade explosion.

To simulate the latter effects, an exercise munition is generally used that disperses a dry charge holding a coloring powder or plaster. Such a munition, which illustratively is described in the British Patent 202,176, however exhibits several drawbacks: Largely because of particulate agglomeration caused by munition storage, powder dispersion will be poor. Moreover the fine granulometry of the powder used makes effectiveness highly dependent on wind conditions. Also the large-distance (of the order of ten meters) efficacy of marking is poor because the particles generally used are too small and do not carry such distances.

Therefore the known munitions do not permit simulating the effects of a fragmenting charge.

The objective of the invention is to provide a munition that overcomes such drawbacks.

Accordingly, the munition of the invention provides excellent marking effectiveness by dispersing a marker composition at a large distance from a target.

The munition of the invention uses a composition which remains effective after periods of storage and which furthermore is washable and non-toxic.

Accordingly the objective of the invention is a marker munition comprising at least one container holding a marker composition and a dispersive explosive charge, said munition being characterized in that the container is substantially cylindrical and the dispersive explosive charge is located at the container axis and in that the marker composition comprises at least one pigment in the form of a water-dispersed solid, coloring powder, this powder being combined with a water-soluble binder and a rheological component which is also water soluble, whose purpose is to agglomerate the pigments and to increase the composition's viscosity, an antifreeze substance furthermore being incorporated into said composition.

The container may be fitted with an annular cavity receiving the marker composition and an axial housing to receive the dispersive explosive charge.

An important feature of the invention, is that the container is made of plastic.

In another feature of the invention, the container is mounted inside a case forming a launch tube, said case containing an ejection charge and being firmly affixed to a firing platform when in use.

Advantageously the ejection charge will be separated from the container by a thrust piston and the container will be enclosed by a rigid, cylindrical jacket comprising at least two half-shells.

The dispersive charge may be initiated by a pyrotechnic delayed-action means which is initiated by the gases produced by the ejection charge.

In a particular embodiment, the munition contains a stack of at least two containers holding a marker composition.

The rheological component may be selected from the group of compounds consisting of: calcium carbonate and barium sulfate.

The binder may be selected from the group of compounds consisting of: polysaccharides, glycerides, cellulose and rubber derivatives.

The pigment may be selected from the group of compounds consisting of: titanium oxide and iron oxide.

The antifreeze substance preferably may be calcium chloride.

The marker composition may be as follows:

40 to 50% by weight water, 17 to 20% by wt calcium chloride 10 to 25% by wt of the sum of titanium oxide and calcium carbonate, 15 to 30% by wt binder.

In a particular embodiment of the invention, the marker composition comprises:

40% by wt water,

18% by wt calcium chloride,

25% by wt of the sum of titanium oxide and calcium carbonate,

17% by wt rubber.

In another embodiment of the invention, the marker composition comprises:

50% by wt water,

20% by wt calcium chloride

15% by wt of the sum of iron oxide and calcium carbonate,

15% by wt rubber.

Other advantages of the invention will be apparent upon reading the following description of particular modes of implementation of the invention in relation to the attached drawings.

Figure 2:
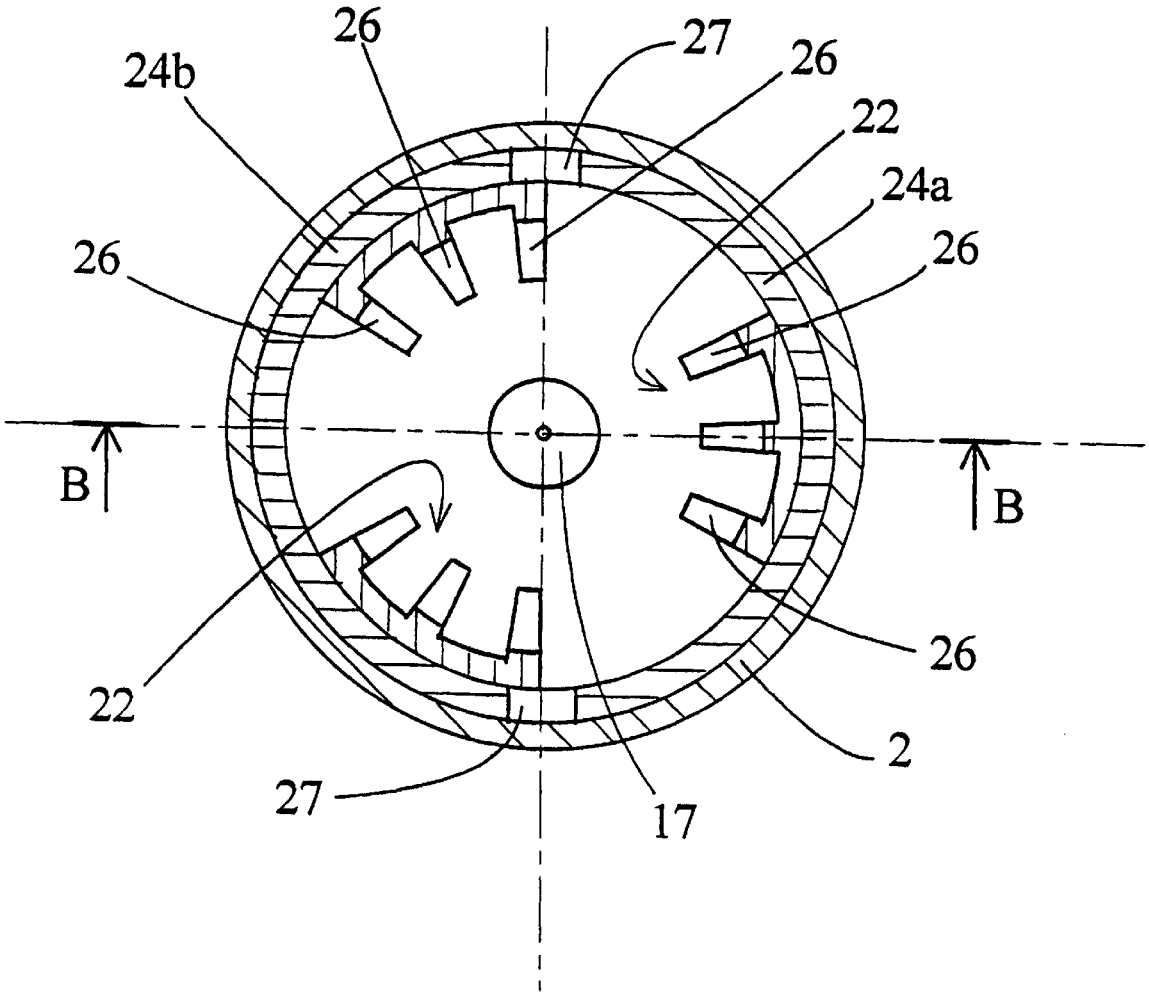
Figure 3:
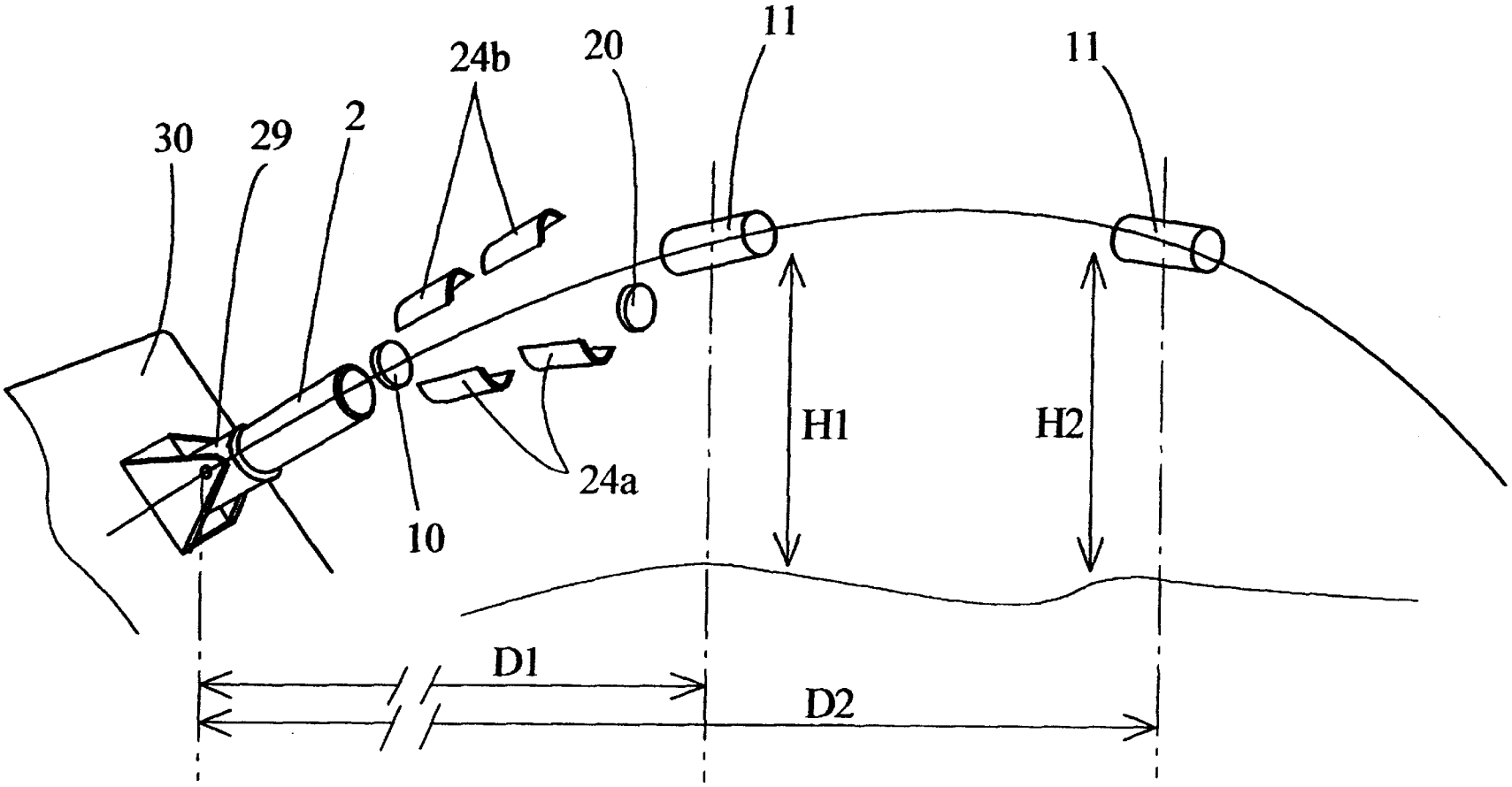

FIG. 1 is a longitudinal section of a munition of the invention in a plane denoted BB in FIG. 2, FIG. 2 is a cross-section of this munition in a plane denoted AA in FIG. 1, FIG. 3 schematically shows the various operational phases of a munition of the invention.

FIG. 1 shows a marker munition 1 of the invention which comprises a case 2 fitted at its rear 2*a* with a base 3 bearing a radial stud 4 to affix the munition in bayonet manner to a launch means (not shown) mounted on an illustratively stationary or vehicular structure.

The case 2 is sealed at its fore part by a stopper 20 affixed to said case by at least one radial pin 21.

The case 2 is fitted with a rear collar 2*b* clamped between a shoulder of the base 3 and a nut 5 screwed onto the base.

The base 3 is fitted with an electric igniter 6 affixed to a support 7 bonded to the base 3. The electric wires of the igniter 6 are connected to an axial contact 8 on one hand and to the base 3 on the other, the axial contact being electrically insulated from the base. The support 7 encloses a pyrotechnic ejection charge 9 illustratively in the form of a propellant or ignition charge.

The case 2 also contains a piston 10 onto which are stacked two marker projectiles 11. In this fashion the case constitutes a launch tube for the projectiles 11, the ejection charge 9 ultimately generating gases acting on the piston 10 which in turn shall expel the projectiles from the case.

Each projectile 11 consists of a container 12 comprising an outer cylindrical wall 12*a* and a cylindrical inner wall 12*b*. These two walls bound an annular cavity closed by a cover 13. The walls are integrally molded using a plastic such as an antistatic, high-density polyethylene (to avert electrostatic discharges that might prematurely initiate a dispersing charge 16) and which is furthermore non-shattering (to avert injurious splinters during initiation).

The annular cavity holds a marker composition 14 of the invention of which the features will be described below.

The cylindrical inner wall 12*b* also bounds an axial housing 15 receiving a dispersive explosive charge 16. The axial housing 15 is sealed at one end by a surface 31 and at the other end by an ignition squib 17 fitted with a pyrotechnic delay-composition 18.

The dispersive charge consists of a pyrotechnic composition illustratively combining aluminum and potassium perchlorate. The delayed-action composition illustratively combines oxidizer, reducing agent and binder (for instance a composition of zirconium/barium-chromate and binder).

The axial housing also contains an inert ballast 19 such as a plastic block. This ballast permits adjusting the free volume in the housing which will receive the dispersive charge 16.

The cover 13 is affixed, for instance by fusion, to the wall 12*a*. It too is made of plastic and is fitted with at least two beads 13*a* which allow filling the container with the marker composition. Initially these beads comprise omitted orifices that are filled after the composition is loaded therein, such filling preferably being carried out by locally melting the cover.

In its rear zone the container 12 comprises three angularly equidistant feet 22 (FIG. 2). Each foot's cross-sectional contour is globally cylindrical over an arc of about 60° and comprises an outer shoulder 23 against which rests a plastic cylindrical jacket 24.

The cylindrical jacket 24 is mounted between the outer container wall 12*a* and the inner cylindrical surface of the case 2.

Each foot 22 also comprises an inner shoulder 25 supporting the piston 10 (for the rear projectile). The shoulder 25 solidly joined to the fore projectile in turn rests against the fore surface of the rear projectile.

The feet 22 are mechanically reinforced by radial ribs 26.

The cylindrical jacket 24 enclosing the rear projectile (in contact with the piston 10) consists of two half-shells 24*a*, 24*b* which do not connect. After the jacket has been assembled, there remain therefore two diametrically opposite longitudinal slots 27 between the two half shells.

The jacket 24 enclosing the fore projectile also consists of two half shells which however do connect to preclude gas from passing in substantial amounts under the cover.

The jackets enclosing the projectiles assure force transmission at the time of firing between the piston 10 and the case-closing cover 20.

Accordingly, the piston by means of the feet 22, pushes the stacked projectiles 11, the rear jacket also being driven by the feet 22 and transmitting the thrust both to the fore projectile and to the fore jacket, latter applying the thrust to the cover 20. In this manner the jackets shear the pins 21 when the pressure of the gases generated by the ejection charge 9 is sufficient.

Such a configuration makes possible circumventing the bursting of projectiles, in which the container 12, being lightweight and made of plastic, could not withstand such compression.

Because of the three angularly equidistant feet 22, three gas-channeling ducts 28 remain between the piston 10 and the inner surface of the case 2.

Part of the propellant gases therefore enters the piston 10 and the rear projectile 11. These gases reliably ignite the delayed-action pyrotechnic composition 18 of the rear projectile, and said composition assures initiation during trajectory of the dispersive charge 16.

The longitudinal slots 27 separating the two rear half shells also permit moving part of the propellant gases toward the space between the two projectiles. In this manner the delayed-action pyrotechnic composition 18 of the fore projectile also is reliably ignited.

The aforementioned slots are gauged in such manner that enough gas is transmitted to initiate the delayed action while averting excessive pressure between the two projectiles whereby the rear one will be slowed.

In the invention, the color marker composition 14 located in the annular cavity of each projectile comprises at least one pigment in the form of a solid coloring powder dispersed in water and combined with a binder which also is water-soluble.

The pigment is selected in relation to the desired marker color. Illustratively, metal oxides such as titanium oxide may be selected for a white marker or iron oxide for a red marker.

To prevent the pigments from settling in water, they are furthermore combined with a rheologic component which itself is also water-soluble.

This component increases the viscosity of the composition and therefore decreases the dangers of settling and separation of the components.

This component also permits increasing the adhesion of the color marker on the target by ensuring particle agglomeration.

Illustratively a carbonate-calcium or barium-sulfate powder may be used as the rheological component.

The binder ensures bonding between pigments and rheological component. It also allows adjusting the composition viscosity and offers film-forming properties, that is, by homogenizing the composition, it assures good spreading of the color marker on the target.

Preferably natural binders such as the polysaccharides (for instance rubber or gutta percha, pectins or alginates), fatty oils (such as glycerides or fatty acid esters and glycerol esters), or derivatives of cellulose or rubber will be used.

Such binders offer the advantage of not being toxic.

Being water-based, the marker composition advantageously also will include an anti-freeze substance, illustratively calcium chloride, to preclude any solidification in the temperature interval of −30° C. and +70° C.

The selected proportions illustratively are as follows:

40 to 50% water, 17 to 20% calcium chloride, 10 to 25% of the sum of titanium oxide mixed with the calcium carbonate, 15 to 30% binder.

The combination of coloring, calcium carbonate and rubber is currently called a "gouache".

Such a composition is prepared as follows:

The pigment and binder are added to the water while being stirred to obtain partial dissolution. The rheological component is then added to this mixture which thereby assumes a pasty consistency forming a gouache. Thereupon the calcium chloride is added in small quantity. The mixture is permanently refrigerated because the dissolution reaction is exothermal.

The components and the proportions are selected to assure a composition dynamic viscosity between 7 and 7.5 Pascals.seconds (Pa.s), and a density between 1.3 and 1.5 g/cm3.

Illustratively the following marker substance compositions (in % by wt) may be prepared:

EXAMPLE 1

40% water

18% calcium chloride

25% of the sum of titanium oxide and calcium carbonate,

17% rubber.

EXAMPLE 2

50% water

20% calcium chloride

15% of the sum of iron oxide and calcium carbonate,

15% rubber.

The relative proportions of metal oxide and calcium carbonate will be determined by the skilled artisan as a function of the desired viscosity of the gouache.

Manufacture of the munitions of the invention will be facilitated using a liquid marker composition.

By selecting a water-based composition, the marker substance can be made easily washable and non-toxic, such features being quite important in making exercise munitions.

Moreover water facilitates the explosive dispersion of the composition.

The initiation of the axial charge causes the generation of droplets, the coloring ability of each droplet being assured by of the homogeneity of the composition of the invention. Also the weight of the droplets is sufficient to ensure proper flight and good dispersion of the composition.

Because the dispersion charge is configured axially, the droplet distribution is axially symmetrical and allows simulating the effects of charge fragmentation.

This combination of an above described projectile structure with such a marker composition overcomes the drawbacks of the prior art and provides a highly effective color marker munition.

The adhesive properties of the composition make it possible to mark a target even at a large distance from said target (about 10 meters).

Accordingly, thanks to the composition of the invention, an exercise munition can be manufactured permitting effective simulation of operation of a real fragmentation charge.

Operation of a munition of the invention is described below in relation to FIG. 3.

The case 2 of the munition of the invention is affixed to a launcher 29 affixed to a vehicle or structure 30.

When firing the exercise munition of the invention, the ejection charge will be initiated and cause opening of the cover 20, ignition of the delayed-action means 18 and expulsion of the two projectiles 11.

As soon as said projectiles are outside the case 2, the two jacket half-shells 24*a*, 24*b* are ejected. The cover 20, the half shells 24*a*, 24*b* and the piston 10 are rapidly decelerated along the trajectory and drop on the ground about 5 to 10 m from the launcher.

The two projectiles 11 move along their ballistic trajectory. Upon the end of combustion of the pyrotechnic delayed-action means 18 of each projectile, the dispersion charge 16 is initiated. It causes an increase of the internal pressure of the munition container 12 whereby said container ruptures on the one hand, and on the other hand the marker composition 14 is dispersed into a cloud of coloring droplets.

The magnitudes of the different delays of the delay-action means 18 are used to initiate each projectile near a desired point of the ballistic trajectory.

Illustratively, a munition may be manufactured wherein a first projectile 11 is initiated a distance D1 of about 25 m from the launcher 29, and a second projectile 11 is initiated a distance D2 of about 40 m from the launcher.

The heights H1 and H2 above the ground are substantially the same for each projectile and approximately 3 m.

The cloud of droplets dispersed by each munition provides a coloring effect as far as about 10 m from the projectile.

The covered area is about 40 m2 when initiation takes place at a height of about 10 m.

Such effectiveness is achieved thanks to a marker composition that avoids any settling phenomenon and therefore ensures homogeneous distance dispersion of a marker cloud with considerable coloring capacity.

Moreover each projectile container 12 is made of plastic and its weight is comparatively low (about 50 g). This case being strongly decelerated along the trajectory during the dispersion phase, its kinetic energy also will be minute and insufficient to injure the troops in the exercise.

In a variation, other kinds of exercise munitions may be made.

Illustratively an exercise mine may be manufactured.

In such a case, the marker munition does not follow a ballistic trajectory but shall be placed on the ground. It comprises then a container holding the composition and a dispersive explosive charge.

Exercise hand grenades also may be made.

In all cases the structure of the munition of the invention combined with the nature of the marker composition it holds overcomes all pigment settling problems during storage.

In this manner the possibilities of a long distance dispersion of the composition can assure while preserving marking effectiveness and homogeneity.

What is claimed is:

1. A marker munition comprising at least one container (12) holding a marker composition (14) and a dispersive explosive charge (16), characterized in that the container (12) is substantially cylindrical, the dispersive explosive charge (16) being located at the level of the axis of the container and in that the marker composition comprises at least one pigment in the form of a water-dispersed, solid coloring powder, said powder being combined with a water-soluble binder and with a rheological component which is also water soluble and which is intended to agglomerate the pigments and to increase the composition's viscosity, said composition furthermore including an antifreeze agent.

2. Munition according to claim 1, characterized in that the container (12) comprises an annular cavity containing the marker composition (14) and an axial housing (15) containing the dispersive explosive charge (16).

3. Munition according to one of claims 1 and 2, characterized in that the container (12) is made of a plastic material.

4. Munition according to claim 1, characterized in that the container (12) is mounted in a case (2) forming a launcher tube, the case containing an ejection charge (9) and intended to be affixed to a firing platform.

5. Munition according to claim 4, characterized in that the ejection charge (9) is separated from the container (12) by a thrust piston (10), and in that the container is enclosed by a rigid cylindrical jacket (24) formed of at least two half-shells (24*a*, 24*b*).

6. Munition according to claim 4, characterized in that the dispersive charge (16) is initiated by a pyrotechnical delayed-action means (18) in turn initiated by the gases produced by the ejection charge (9).

7. Munition according to claim 4, characterized in that it comprises a stack of at least two containers (12) holding a marker composition.

8. Munition according to claim 1, characterized in that the rheological component is selected from the following compounds: calcium carbonate, barium sulfate.

9. Munition according to claim 1, characterized in that the binder is selected from the following compounds: polysaccharides, glycerides, cellulose or rubber derivatives.

10. Munition according to claim 1, characterized in that the pigment is selected from the following compounds: titanium oxide, iron oxide.

11. Munition according to claim 1, characterized in that the antifreeze agent is calcium chloride.

12. Munition according to claim 1, characterized in that the marker composition comprises:

40 to 50% by wt water, 17 to 20% by wt calcium chloride, 10 to 25% by wt of the sum of titanium oxide and calcium carbonate, 15 to 30% by wt binder.

13. Munition according to claim 12, characterized in that the marker composition comprises:

40% by wt water,

18% by wt calcium chloride,

25% of the sum of titanium oxide and calcium carbonate,

17% by wt rubber.

14. Munition according to claim 12, characterized in that the marker composition comprises:

50% by wt water,

20% by wt calcium chloride,

15% by wt of the sum of iron oxide and calcium carbonate,

15% by wt rubber.

* * * * *